United States Patent [19]

Masachika

[11] Patent Number: 4,573,416

[45] **Date of Patent: * Mar. 4, 1986**

[54] AFTER HOUR DEPOSITORY

[75] Inventor: Hiroshi Masachika, Hiroshima, Japan

[73] Assignee: Kumihara Safe Co., Inc., Japan

[ * ] Notice: The portion of the term of this patent subsequent to Dec. 25, 2001 has been disclaimed.

[21] Appl. No.: 469,311

[22] Filed: Feb. 24, 1983

[30] Foreign Application Priority Data

Oct. 2, 1982 [JP] Japan ..... 57-172538

[51] Int. Cl.[4] ..... E05G 1/026

[52] U.S. Cl. ..... 109/66; 109/8; 232/44

[58] Field of Search ..... 109/5-8, 109/46, 48, 64, 66, 74, 59 R; 232/44, 43.3

[56] References Cited

U.S. PATENT DOCUMENTS

| | | | |
|---|---|---|---|
| 2,716,584 | 11/1952 | Behrens | 109/66 |
| 2,901,165 | 8/1959 | Krug | 232/44 |
| 3,465,955 | 9/1969 | DeBoer et al. | 232/44 |
| 3,762,634 | 10/1973 | Leipelt | 232/44 |
| 3,784,090 | 1/1974 | Markham | 232/44 |
| 4,063,520 | 12/1977 | Parsons | 109/66 |
| 4,176,610 | 12/1979 | Markham et al. | 109/66 |
| 4,489,622 | 12/1984 | Masachika | 109/66 |

*Primary Examiner*—Kenneth J. Dorner

*Assistant Examiner*—Neill Wilson

*Attorney, Agent, or Firm*—Cushman, Darby & Cushman

[57] ABSTRACT

An improved after hour depository is disclosed which essentially comprises a door casing turnable about a shaft extending across both the side walls of a framework on a bank building, a movable wall in operative association with the door casing so as to a develop a pocket, a rotary stopper fixedly secured to the door casing at its lower end part, a sleeve roller adapted to be displaced together with the movable wall, a ratch mechanism for defining the movement of the sleeve roller, a sliding member for turning the movable wall and a steal activity protection means.

The improvement consists in that the stealing activity protection means comprises a stealing activity protection plate fixedly secured to the movable wall at its lower end part and an arm ratch so that any close clearance between the corrugated surfaces of both the door casing and the guide member is completely filled. Further, the stealing activity protection means includes arcuate grooves formed on the inside walls of the door casing and pins projected from the side faces of the movable wall so as to be fitted into the arcuate grooves.

Protection from any stealing activity is principally ensured in such a manner that a shaft extending across the side walls of the framework is depressed against the upper face of the ratch mechanism.

25 Claims, 11 Drawing Figures

(a)

(a)

(b)

AFTER HOUR DEPOSITORY

BACKGROUND OF THE INVENTION

1. Field of the Invention

The present invention relates to an improved after hour depository and more particularly to an after hour depository which promotes increased safety against theft during opening and closing operations of the depository.

2. Description of the Prior Art

A conventional after hour depository is typically constructed such that a chute extends from a depository's opening through the side wall of a bank building into a safe or a depositing receptacle. A door opening and closing device is typically arranged outwardly of an entrance chute so that a bag or an envelope containing money to be deposited slides therethrough due to its own dead weight when the door opening and closing device is operated.

A bag or envelope typically have a tag card attached thereto on which the value of money being deposited, a client number or the like due to the inherent size difference between bags and envelopes separate depositor openings are typically provided. After hour depositories must provide an optimum protective arrangement which prevents criminal activity conducted from the outside, for example, as by an unauthorized person retrieving the deposited bar or envelope with the use of a steel wire having a fishing hook or the like at its end. It should be noted that after hour depositories are normally operated during night hours when few people nearby. Thus, high safety is required for after hour depositories.

In general, criminal activity includes stealing of a bag an envelope, damaging or the depository, removal of the whole depository from its surrounding structure and others, each of which is typically carried out in the night hours. If an unauthorized person who is desirous of stealing a deposited bag or envelope is knowledgeable of the interior structure of the depository, a variety of security defeating operations may be devised and practiced without much difficulties. Due to the requirement for perfect protection from criminal activities, the conventional after hour depository becomes structurally complicated thereby increasing its manufacturing costs.

Particularly, since conventional locking mechanisms for after hour depositories are designed and constructed in a complicated manner, the number of manufacturing steps for the after hour depository is increased, resulting in an elevated manufacturing cost.

SUMMARY OF THE INVENTION

The present invention is intended to obviate the drawbacks inherent to the conventional after hour depository as described above.

An improved after hour depository in accordance with the present invention essentially comprises in combination a door casing fitted into a framework in a bank building in such a manner as to pivot about a shaft horizontally extending across both the side walls of the framework. A movable wall is disposed in operative association with the door casing so as to establish a pocket into which a bag or an envelope containing money to be deposited is placed. The movable wall includes a free end adapted to come into sliding contact with a concave surface of a partition constituting a part of the door casing, a rotary stopper fixedly secured to the lower part of the door casing to define the closing position of the depository, a sleeve roller disposed rotatably about a shaft horizontally extending across both the side walls of the door casing, a ratch mechanism for guiding and defining the movement of the sleeve roller, (the ratch mechanism being fixedly secured to the side wall of the framework) a sliding member fixedly secured to the side wall of the framework so as to allow the movable wall to be pivoted in such a direction as to eliminate the pocket in cooperation with the sleeve roller and a theft protection system arranged about the door casing.

Basically, protection from any kind of criminal activity is ensured in such a manner that a shaft horizontally extending across the movable wall is depressed against the upper face of the ratch mechanism so as to prevent any pivotal movement of the ratch mechanism in an incorrect direction.

The improvement of the invention herein consists in that protection from any criminal activity is additionally ensured by means of the theft protection means comprising a theft protection plate fixedly secured to the movable wall at its lower end part and an arm ratch attached to the door casing so as to lock the sleeve roller when the pocket is established whereby any clearance between the corrugated surfaces of both the door casing and the guide member is completely blocked.

In a preferred embodiment of the present invention, the theft protection system further includes arcuate grooves formed on the inside walls of the door casing and having a center of curvature at the axis of the movable wall. Pins projecting from the side faces of the movable wall are operatively fitted into the arcuate grooves.

In general, the ratch mechanism comprises a ratch including an engagement pawl formed with a concave part at which sleeve roller is adapted to be firmly held during the return movement, an auxiliary plate integral with the ratch, a driving plate located opposite to the ratch. The driving plate is normally energized to pivot in the opposite direction relative to the ratch, and a holding plate which is disposed in operative association with the driving plate. The driving plate is adapted to engage or disengage the ratch by means of a retaining rod fixedly mounted on the ratch.

A bank visitor can manipulate the door casing to the half-opened state without the necessity for a key. In the half-opened state, an envelope containing money to be deposited can be placed into the pocket. However, when the bank visitor deposits his money using a bag or the like, it is necessary that he manipulate the door casing to the fully opened state after first turning a key-actuated rotary stopper plate.

Thus, it is an object of the present invention to provide an improved after hour depository which ensures perfect protection from any kind of criminal activity.

It is other object of the present invention to provide an after hour depository which is durably and is easily handled by a bank visitor.

It is another object of the present invention to provide an after hour depository which is simple in structure and can be manufactured at an inexpensive cost.

Other objects, advantages and features of the present invention will become apparent from a reading of the following description in connection with the accompanying drawings.

BRIEF DESCRIPTION OF THE DRAWINGS

The accompanying drawings will be briefly described below, wherein:

FIG. 3(*b*) is a partial sectional front view of the after hour depository as seen in the direction identified with an arrow marked in FIG. 3(*a*);

FIG. 7(*b*) is a partial sectional front view of the after hour depository in FIG. 7(*b*);

FIG. 8(*b*) is a schematic side view of the combination in FIG. 8(*a*) in the second operative position, shown in the same enlarged scale.

DETAILED DESCRIPTION OF THE EMBODIMENT

The present invention will now be described in a greater detail with reference to the accompanying drawings which illustrate a preferred embodiment of the invention.

Figure 1:
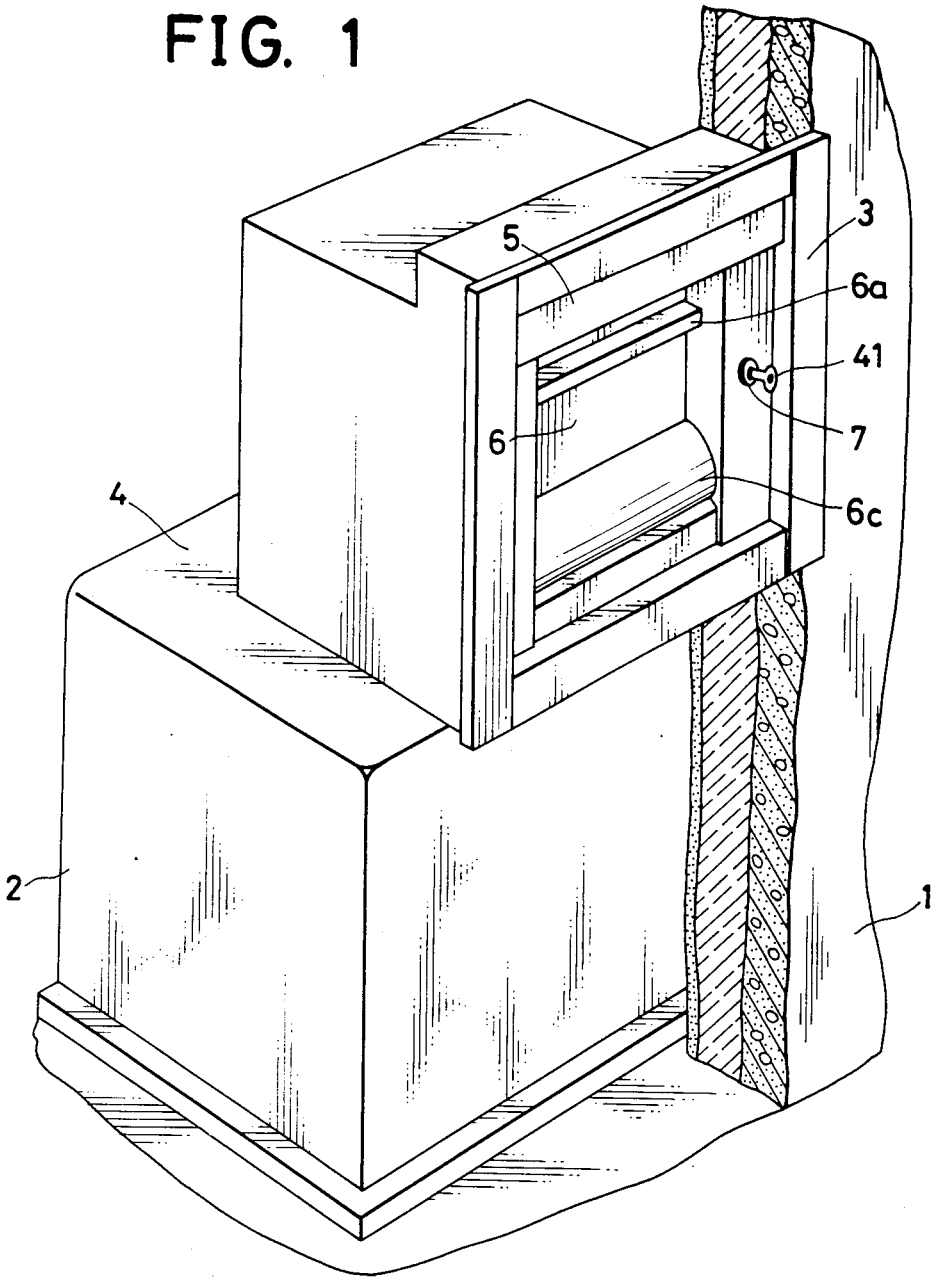
FIG. 1 is a perspective view of an after hour depository fitted into a wall structure of a building which is broken away for the convenience of illustration.
Figure 2:
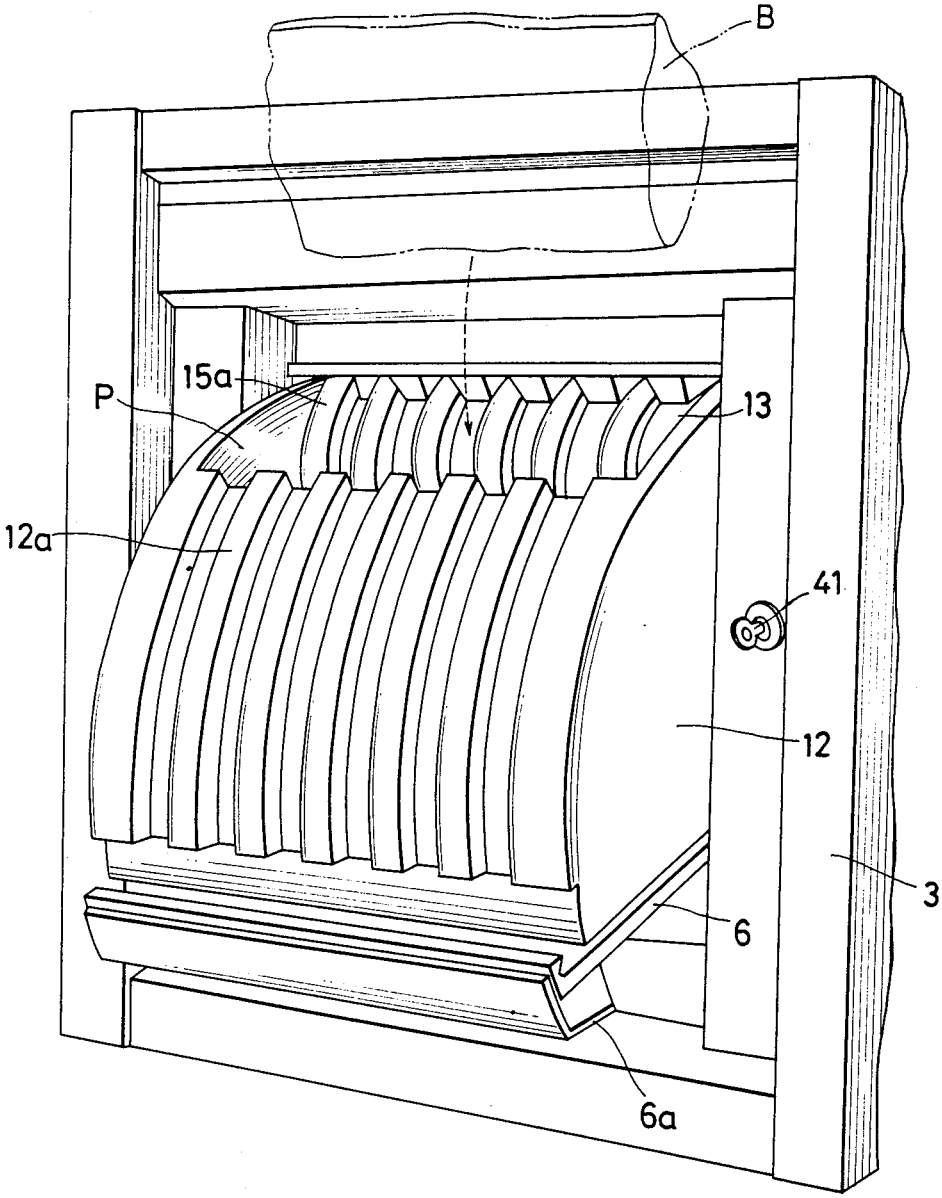
FIG. 2 is another perspective view of the after hour depository in FIG. 1, wherein a door is shown in an opened state.
Figure 3:
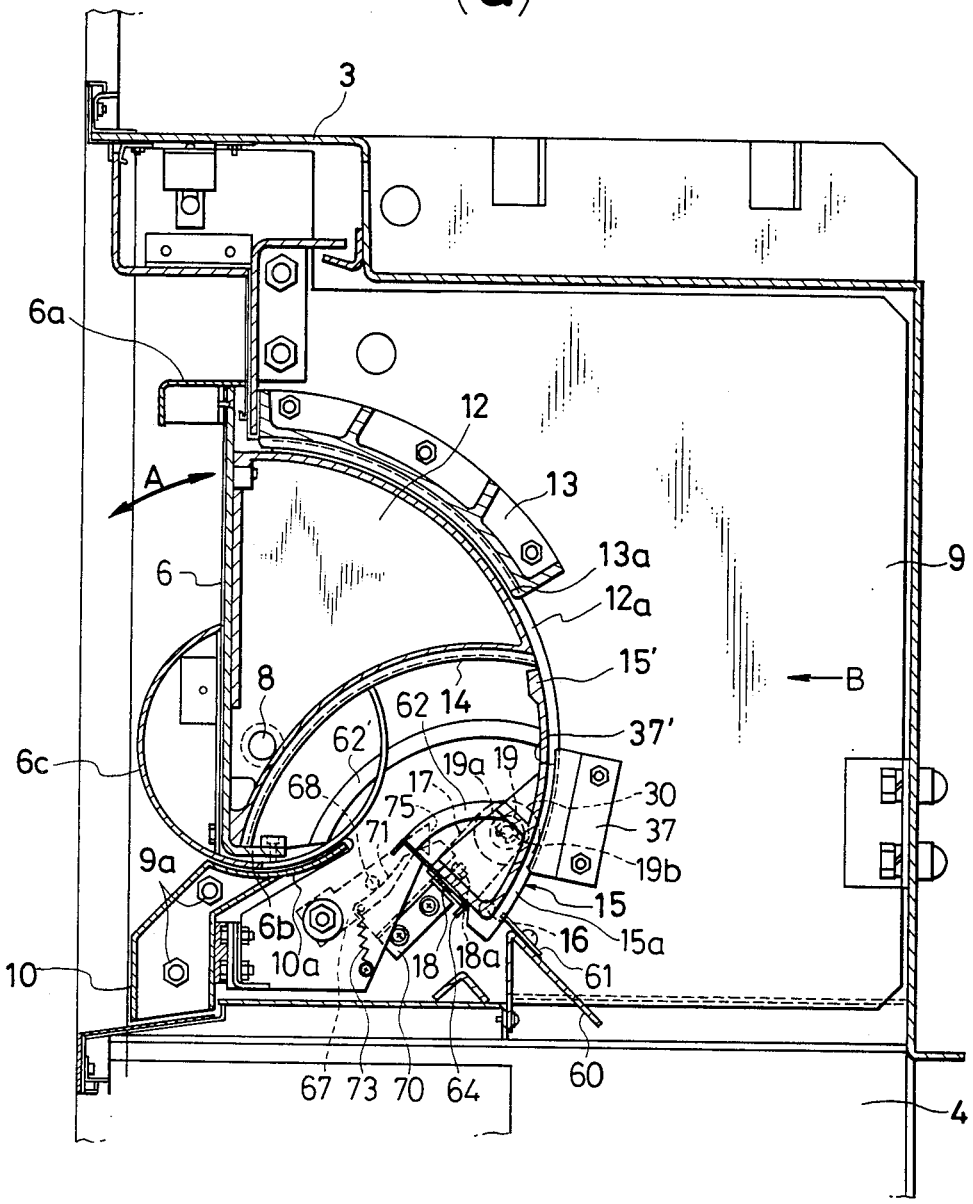
FIG. 3(*a*) is a vertical sectional side view of the after hour depository with the door fully closed.
Figure 3:
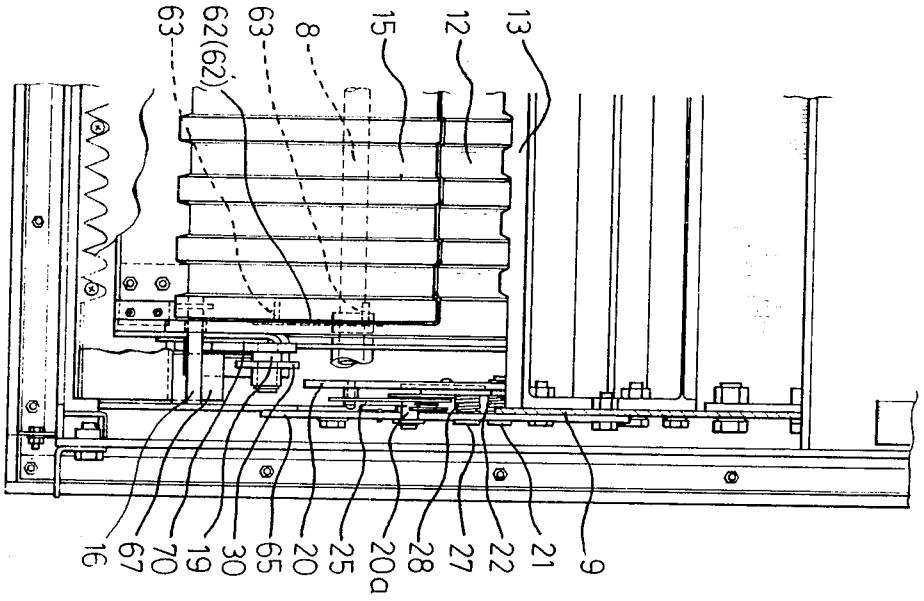

Referring first to FIGS. 1 to 3, an after hour depository 2 is rigidly installed inside a wall structure 1 of a bank building having a square opening fitted with framework 3. A chute 4 extends downward into the after hour depository 2. A lamp 5 and a front plate of a door casing 12 are provided so as to be on the exterior side of wall section 1. Front plate 6 includes a handle 6*a* at its upper part and a holding portion 6*b* at its lower part thereof, the holding portion 6*b* being bent inwardly relative to the wall structure 1. Further, the framework 3 is formed with an aperture 7 through which a cylinder lock is fixedly fitted so as to effect locking and unlocking by means of a key 41.

As is best seen from FIG. 3, the front plate 6 of the door casing 12 includes a semi-circular cylindrical portion 6*c* at its lower part and a pivotal shaft 8 extends across both the side walls 9 of the after hour depository along the center line of semi-circular cylindrical portion 6*c*. In such a manner, the door casing 12 is pivotally held about the pivotal shaft 8. Further, below the cylindrical portion 6*c* of the front plate 6 is arranged a guide member 10 which includes a trough-shaped guide 10*a* fixedly secured to the inside surface of both the side walls 9 by means of bolts 9*a*. Door casing 12 is formed integral with the front plate 6, and defines a sector-shaped configuration as seen from the side. Specifically, the door casing 12 is pivotal about the pivotal shaft 8 in both clockwise and counterclockwise directions (as identified by arrow A in FIG. 3(*a*)) so as to open and close the combination of the front plate 6 and the door casing 12. A guide member 13 is adapted to be brought in sliding contact with the door casing 12 along the arcuate surface of the latter in such a manner that the corrugated surface 12*a* of the door casing 12 is in engagement with the corresponding corrugated surface 13*a* of the guide member 13. Further, the door casing 12 includes a concave partition 14 constituting its rear wall and a movable wall 15 is pivotally disposed about a shaft 16 which is located at the lower end part of the door casing 12. It should be noted that the position of the shaft 16 corresponds to the center of the curvature of the concave partition 14 whereby the upper end part of the movable wall 15 is caused to move along the concave surface of the partition 14. Thus, when the door casing 12 is drawn forward using the handle 6*a* of the front plate 6, a pocket P is developed (see e.g. FIG. 5).

An inclined plate 60 is disposed below moveable wall 15 and includes a limiting plate 61 fixedly secured thereto, said limiting plate 61 being configured so as to be engaged with a corrugated surface 15*a* of the movable wall 15 (see FIG. 3(*a*)).

On the other hand, on both the inner surfaces of the side walls of the door casing 12 there are fomred arcuate grooves 62 and 62′ both of which have a center of curvature corresponding to the center of the shaft 16. Pins 63 project from the side faces of the movable wall 15 and are adapted to slide along arcuate grooves 62 and 62′ (see FIG. 3(*b* )).

A pair of arms 17 are fixedly secured to the lower extension of the movable wall 15 by means of bolts 18 and nuts 18*a* at both the sides thereof and a sleeve roller 19 is rotatably held by means of a shaft 19*a* disposed at the free end of each of the arms 17 using stopper rings 19*b*.

Further, a theft protection plate 64 is fitted integrally to the lower part of the movable wall 15 to prevent security defeating activity, such the use of a steel wire having a fishing hook or the like at its top end attempted to be inserted into the space between moveable wall 15 and guide member 13.

Figure 7:
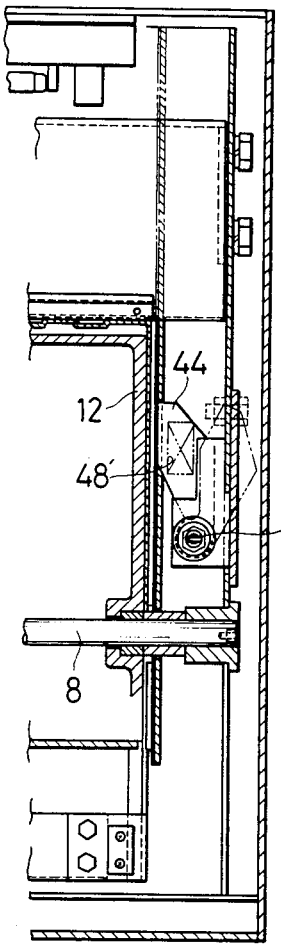
FIG. 7(*a*) is a vertical sectional side view of the after hour depository, particularly illustrating a locking mechanism therefor.
Figure 7:
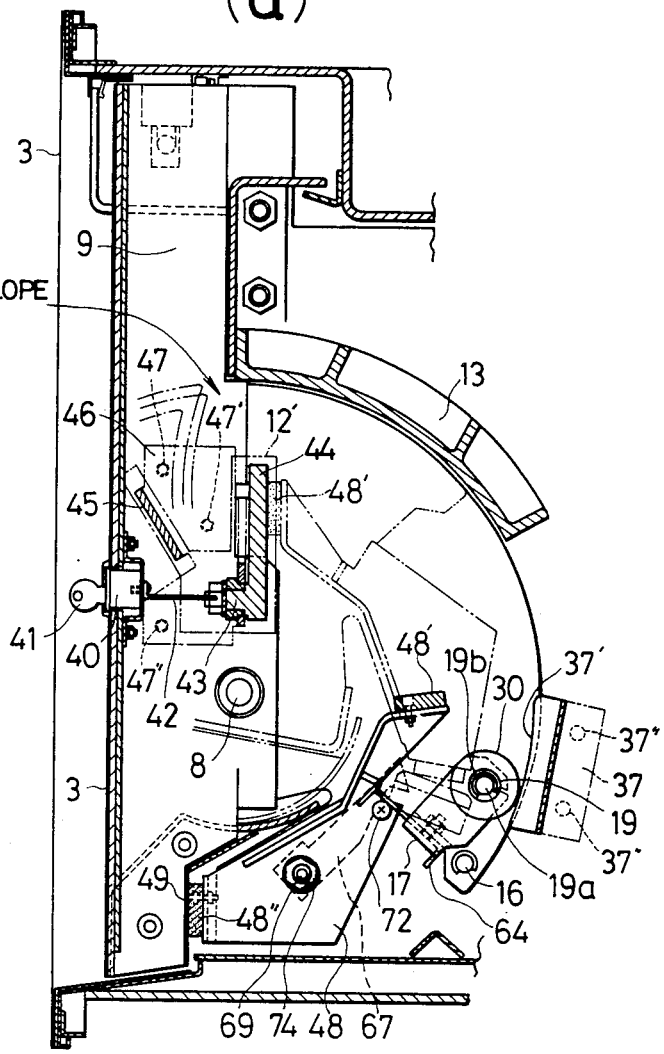

As is best seen from FIG. 7, a rotary stopper 48 is fixedly attached to the side wall of the door casing 12 at its lower part by means of bolts 69 and 72 and nuts 74 and includes shock absorbers 48′ and 48″ fixedly secured to both the upper and lower end parts thereof. Further, an arm ratch 67 is disposed by the side surface of the door casing 12 by means of the bolt 69 and the nut 74 in such a manner as to pivot about the bolt 69 which serves to fixedly attach the rotary stopper 48 to the door casing 12. The arm ratch 67 includes a pin 68 fixed at its middle part which is adapted to abut against a guide portion 71 of an arm ratch guide member 70 fixedly secured to the side wall 9 under resilient force of a coil spring 73. Coil spring 73 thus urges the arm ratch 67 to turn in the clockwise direction about bolt 69 as seen in the drawing (see FIG. 3).

Figure 4:
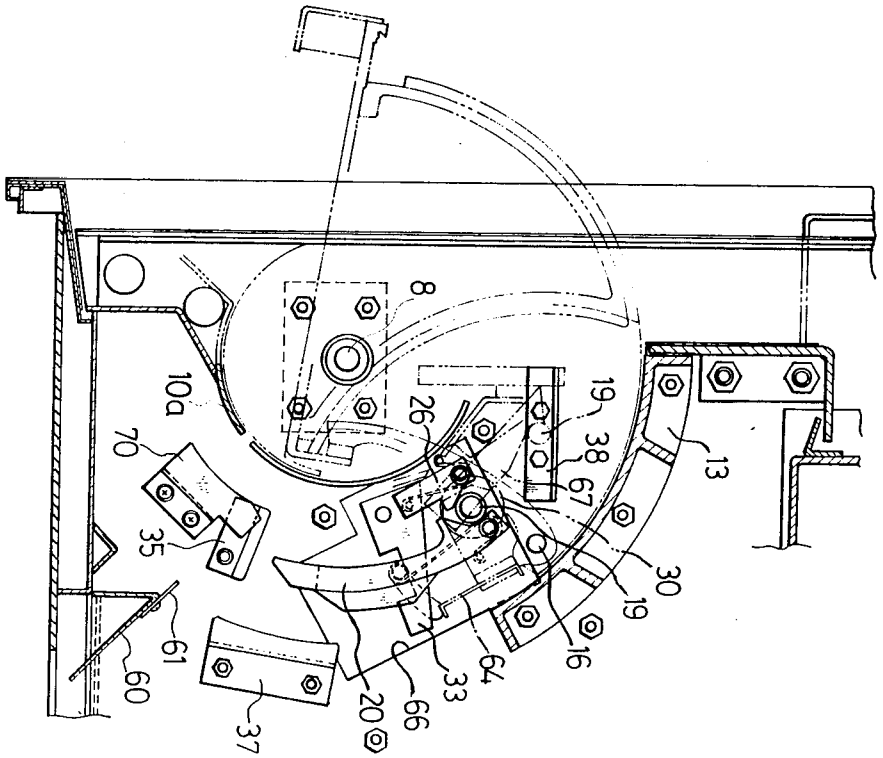
FIG. 4 is a vertical sectional view of the after hour depository similar to FIG. 3(*a*), wherein the door is shown in a half-opened state.
Figure 5:
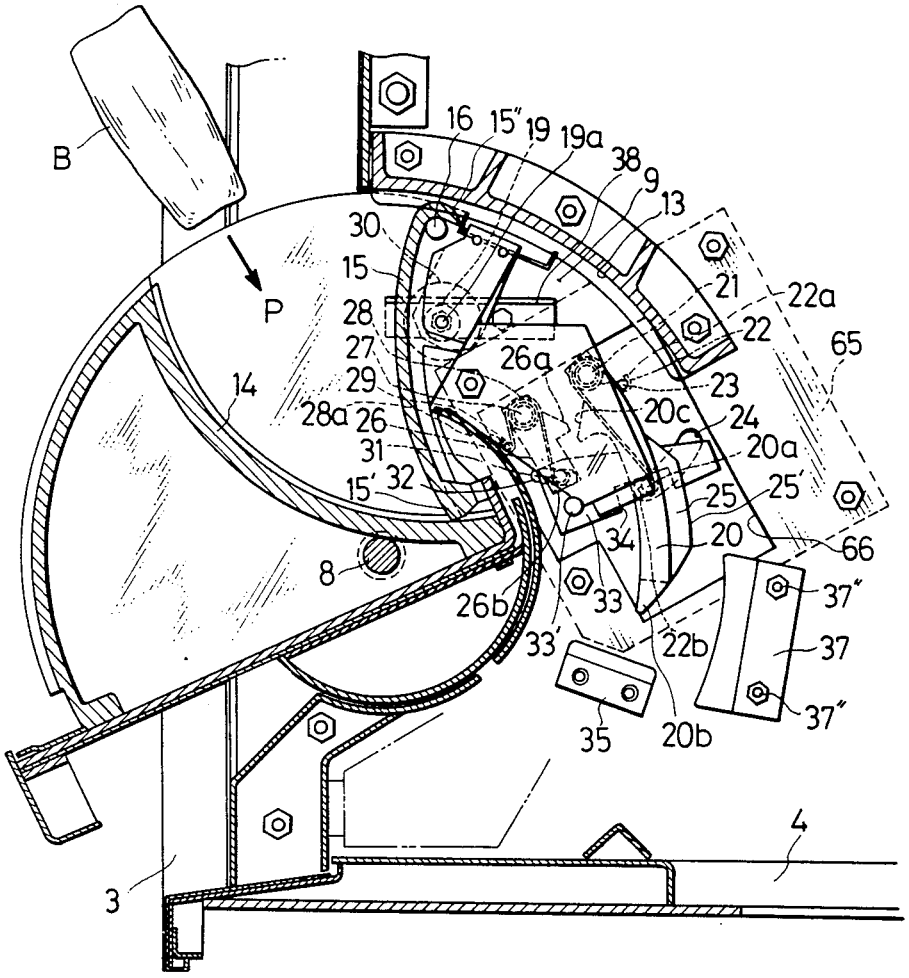
FIG. 5 is a vertical sectional view of the after hour depository in a fully closed state, shown in a scale larger than that, of FIGS. 3 and 4.
Figure 6:
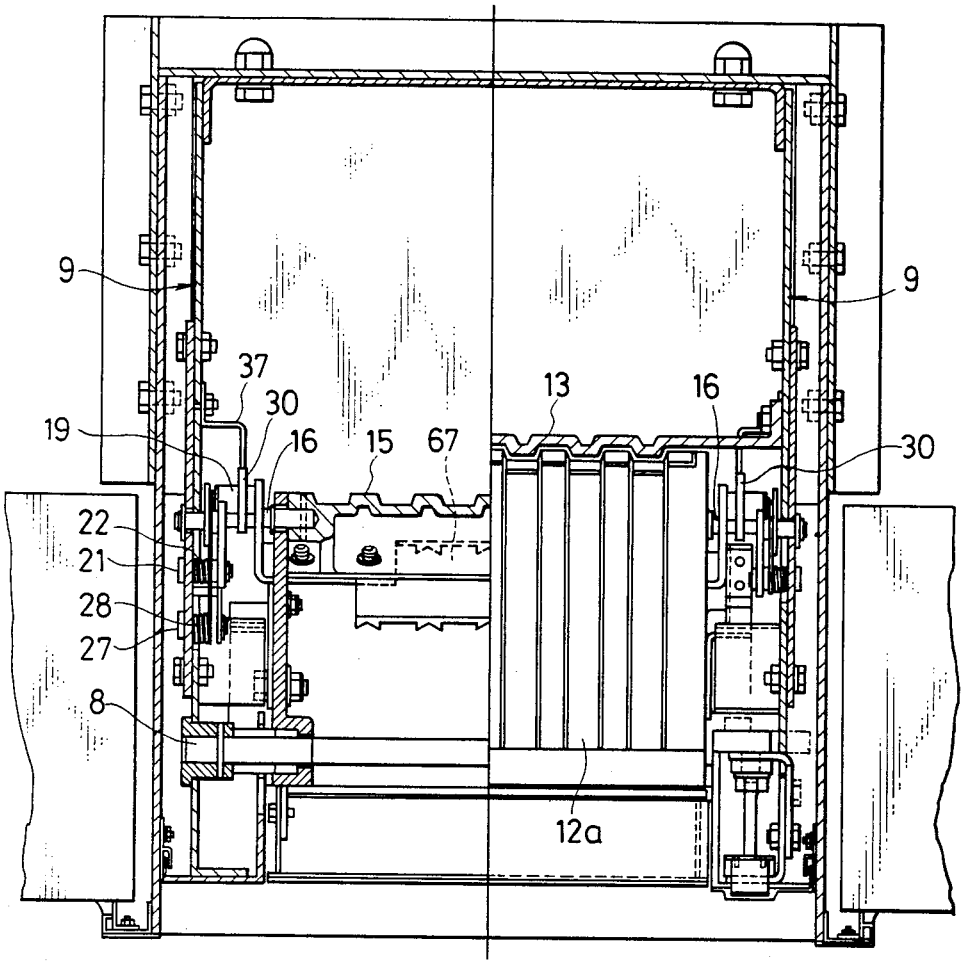
FIG. 6 is a sectional view of the after hour depository, wherein both the left and right hand halves thereof are sectioned at a position different from one another.

Referring to FIGS. 4 and 5, the side wall 9 of the after hour depository has a cutout 66 to which a plate 65 is fixedly fitted so as to pivotally carry a ratch 20 at its lower part, the ratch 20 being formed with an engagement pawl 20c on its lower face. Specifically, the ratch 20 is pivotally mounted on a shaft 21 at its upper end part which extends horizontally from the plate 65,. Shaft 21 also includes a spring 22 fitted thereon, said one end 22a of said spring 22 being anchored to a projection 23 horizontally extending from the plate 65, while the other end 22b of spring 22 is fixedly engaged to a retaining rod 20a which is located at the central part of the ratch 20. Thus, the ratch 20 is normally urged to pivot toward the pivotal shaft 8 in the clockwise direction as seen in the drawing under resilient force imparted by the spring 22. The extent of pivotal movement of the ratch 20 in the clockwise or counterclockwise direction at its lower end 22b is limited by means of the retaining rod 20a which extends through an elongated hole 24 formed on the plate 65. An auxiliary ratch plate 25 is also provided integral with the ratch 20.

A driving plate 26 is mounted pivotally about a shaft 27 at its upper end part in such a manner that its lower end part is reciprocally pivoted in the clockwise or counterclockwise direction. The driving plate 26 is formed with a feed pawl 26a which is located opposite to the rear face 20d of the engagement pawl 20c of the ratch 20. As is readily apparent from the drawing, the feed pawl 26a is from the engagement pawl 20c of the ratch 20.

A spring 28 is fitted on the shaft 27 in such a manner that the one end 28a of spring 28 is fixedly anchored to a projection 29 horizontally extending from the plate 65 while the other end 28b of spring 28 is fixedly engaged to a connecting pin 31 at the lower end part 26b of the driving plate 26. In such a manner, driving plate 26 is normally urged to pivot toward the ratch 20 in the counterclockwise direction. The lower end part 26b of the driving plate 26 is operatively connected to the left end part of a holding plate 33 by way of the connecting pin 31 which extends through the driving plate 26 and projects into an elongated guide hole 32 on the plate 65. The holding plate 33 is disposed pivotally about a shaft 33' horizontally extending from the plate 65 and is formed with a rectangular recess 34 at its bottom face so that the retaining rod 20a is brought into engagement therewith as the holding plate 33 pivot in the clockwise direction.

Figure 8:
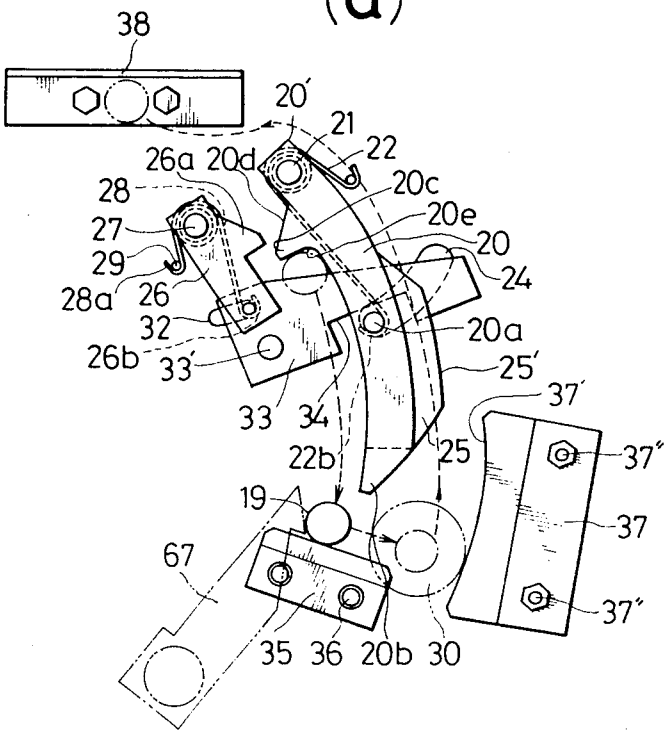
FIG. 8(*a*) is a schematic side view of a combination of a sleeve roller and a ratch mechanism in the first operative position, shown in an enlarged scale.
Figure 8:
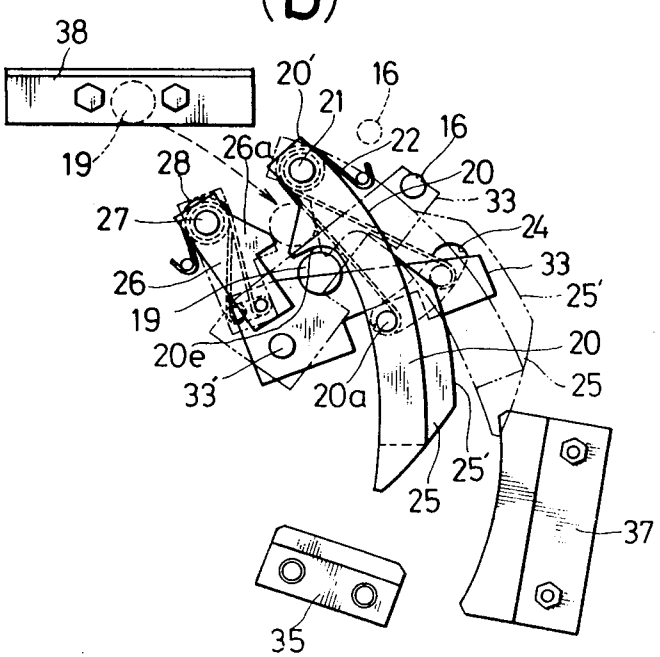

As illustrated in FIG. 8(*b*), the shaft 16 allows the movable wall 15 to pivot thereabout and extends between both the side walls 9 of the after hour depository, shaft 16 thus depresses the upper face 25' of the auxiliary ratch plate 25 of the ratch 20 until a locked state is achieved for the purpose of preventing any security-defeating activity from being carried out by an unauthorized person in such a manner as will be described in greater detail below later. A sliding guide member 35 is also provided so as adapted to allow a roller 19 to slide therealong. The sliding guide member 35 is fixedly secured to the side wall 9 of the after hour depository by means of bolts 36. Further, another guide member 37 is fixedly secured to the side wall 9 by means of bolts 37'', the guide member 37 having the same corrugated configuration as that of the free end part of the movable wall 15. A stopper angle 38 adapted to allow the roller 19 to abut thereagainst in such a manner as will be described in greater detail below. The stopper angle 38 is fixedly attached to the side wall 9 with the aid of bolting means which are not shown in the drawing.

FIG. 7(*a*) is a sectional side view of the after hour depository particularly illustrating a locking mechansim, whereas FIG. 7(*b*) is a partial sectional front view of the after hour depository in FIG. 7(*a*). The locking mechanism as illustrated in the drawings is constructed such that a key is required for the purpose of unlocking only when a bag or the like means containing money to be deposited is put into the depository. On the other hand, when using an envelope or the like means containing money to be deposited, any bank visitor can manually open the door without the necessity of a key until the first door opening position is reached whereby he can then insert the envelope or the like into the pocket through the partial opening. Specifically, the locking mechanism essentially comprises a cylinder head 40 fitted into the framework 3, a connecting rod 42 adapted to be turned by means of the key 41, a locking shaft 43 operatively connected to the connecting rod 42, a rotary locking plate 44 integral with the locking shaft 43, the rotary locking plate 44 being engageable and disengageable with the side wall upon rotation of the connecting rod 42, and a stopper plate 45 which allows the door casing to be drawn forward to the second position where it is fully opened to such an extent that a bag or the like can be placed into the pocket. A seating plate 46 integral with the stopper plate 45 is fixedly secured to the side wall 9 by means of bolts 47, 47' and 47''. It should be noted that the rotary locking plate 44 is normally projected toward the side wall of the door casing 12 so that a rotary stopper 48 having a shock absorbing member attached to its front end part comes into abutment against the rotary locking plate 44 at the first position where the door casing is half-opened. When unlocking is effected by means of the key, the rotary locking plate 44 is turned away from the side wall of the door casing 12 in the clockwise direction as seen in FIG. 7(*b*). On the other hand, while the door casing 12 is fully closed, the lower end part 48'' of the rotary stopper 48 is brought into abutment against a stopper plate 49 fixedly disposed at the lower part of the framework 3. Thus, the door casing 12 can be drawn forward from the above-mentioned fully closed position to the fully opened position by way of the first door opening position where it is half opened as illustrated by two-dot chain lines in FIG. 7(*a*). When the door casing 12 is fully opened as illustrated in FIG. 5, the upper end part 48' of the rotary stopper 48 is caused to abut against the stopper plate 45. As is apparent from the above description, the door casing 12 can be pivoted within the extent as defined by both the fully closed position and the fully opened position.

The operation of the after hour depository constructed in the above-described manner now will be described below.

In order to open the fully closed door casing 12, the door casing 12 is drawn forward by means of the handle 6a from the fully closed position as illustrated in FIG. 3(*a*) where the door casing 12 is kept closed and the rotary stopper 48 is lowered to the lowermost position (it should be noted that the movable wall 15 is held upright by means of the guide ring 30 adapted to come in contact against the guide member 37 so as to prevent it from turning over in the rearward direction). As it is turned in the direction of door opening, the position as illustrated by two-dot chain lines in FIG. 7(*a*) is first reached while the rotary locking plate 44 is held locked and thereafter the position where the upper end part 48' of the rotary stopper 48 comes in abutment against the stopper plate 45 is reached with the rotary locking plate 44 displaced from the locked state whereby the door casing 12 is fully opened as illustrated in FIG. 5.

Operation of the movable wall 15, the ratch 20 and the sleeve roller 19 during the door opening will be described below with particular reference to FIGS. 8(*a*) and 8(*b*).

While the door casing 12 is held in the fully closed state, the movable wall 15 stands upright and the outer curved surface of the door casing 12 forms a continuation to that of the movable wall 15. As the door casing 12 is forwardly pivoted, the guide ring 30 rotatably mounted on the shaft 19*a* of the arm 17 is caused to slide upward while it comes in rolling contact with the guide surface 37' of the guide member 37. As the door casing 12 is pivoted further, the guide roller 30 continues to slide upward along the guide surface of the guide member 13, while the sleeve roller 19 slides along the upper face 25' of the ratch 20 (FIGS. 8(*a*) and (*b*)). As can be seen, as the sleeve roller 19 leaves the upper edge 20' of the ratch 20, the movable wall 15 starts to turn downward about the shaft 16 in the anticlockwise direction due to its own dead weight while the free end part 15' of the movable wall 15 is brought in contact with the concave wall 14 of the door casing 12. When the latter is fully opened and its free end part 15' comes in abutment against the lower extension of the front plate 6, a pocket P is developed between the door casing 12 and the movable wall 15 as illustrated in FIG. 5. At this moment the upper end part 48' of the rotary stopper 48 abuts against the stopper plate 45 and thereby the door casing 12 comes to a stop. The door casing 12 is thus ready for receiving a bag or an envelope B in the pocket P.

Operation for door closing will now be described below.

After placing the bag or envelope containing money to be deposited on the pocket P, a bank visitor manually grasps the front plate 6 at the handle 6*a* and urges the door casing 12 in the backward direction whereby the door casing 12 is caused to pivot about the shaft 8 in the clockwise direction, that is, in such a direction as to close the pocket P, while it is guided by means of the guide member 13. At this moment the sleeve roller 19 is displaced downward along the track different from that during the upward movement as illustrated in FIGS. 8(*a*) and (*b*) so as to depress the driving plate 26 and thereby actuate the holding plate 33 which is in operative association with the former by way of connecting pin 31. As a result the holding plate 33 becomes disengaged from the retaining rod 20*a* and thereby the ratch 20 is caused to swing about the shaft 21 in the rearward direction, that is, in the anticlockwise direction against the resilient force imparted by the spring 22. Then, the sleeve roller 19 moves down along the feed pawl 26*a* of the driving plate 26 and passes through the space as defined between the driving plate 26 and the ratch 20 whereby both the driving plate 26 and the ratch 20 pivot about the respective shafts 27 and 21 in an opposite direction relative to one another. As the sleeve roller 19 continues to move down, it is disengaged from the feed pawl 26*a* of the driving plate 26 and then the latter resumes the original position under the resilient force of the spring 28. At this moment the connecting pin 31 moves back along the elongated guide hole 32 on the side wall 9 and thereby the retaining rod 20*a* on the ratch 20 comes in engagement to the rectangular recess 34 on the holding plate 33 as if the latter rides over the former. As the sleeve roller 19 moves downward further, it reaches the concave part 20*e* of the engagement pawl 20*c* on the ratch 20 and then it is resiliently held between the driving plate 26 and the ratch 20 with the aid of the spring 22 which serves to normally pivot the ratch 20 in the clockwise direction. As a result, the sleeve roller 19 is firmly locked at the concave part 20*e* of the ratch 20 whereby the pocket P is displaced to the position where it is received in the interior of the framework 3 thereby preventing visual inspection of the pocket P from the outside i.e. direction reversal is prevented. Thus, there is no fear that the door casing can be reopened by tricking security-defeating activities which may be conducted by an unauthorized person who is desirous of stealing the bag or envelope on the pocket P (see FIGS. 4 and 8(*b*)).

When the door casing 12 is half opened to the first door opening position as identified by the two-dot chain lines in FIG. 4 where the pocket P is developed with the free end part 15' of the movable wall 15 brought in abutment against the lower extension 6*b* of the front plate 6 which serves as a stopper, the arm ratch 67 becomes effective in holding the sleeve roller 19 in a locked state. Next, when is urged further in a closing the door casing 12 direction, the movable wall 15 is disengaged from the stopper angle 38 whereby it becomes impossible to carry out any theft activity with the use of a steel wire having a fishing hook or the like at its end. Even if one attempts to raise the free end part 15' of the movable wall 15 and displace the stealing activity protection plate 64 away from the corrugated surface 13*a* of the guide member 13 to form some clearance therebetween, the movable wall 15 cannot be pivoted in the reverse direction owing to the operative locked interengagement between the sleeve roller 19 and the arm ratch 67.

Specifically, the stealing activity protection plate 64 is closely engaged with the corrugated surface 13*a* of the guide member 13 and thereby one cannot insert a steel wire or the like through a clearance between the end part 15'' of the movable wall 15 and the guide member 13 so as to pick up the envelope with a tag card attached thereto.

Further, since the arcuate grooves 62 and 62' are recessed on both the inside wall surfaces of the door casing 12 and the pins 63 and 63' projected from both the side faces of the movable wall 15 are engaged to the arcuate grooves 62 and 62', it is entirely impossible to draw the envelope out of the pocket P even should the thief be able to catch the tag card attached to the envelope using a fishing hook at the end of an inserted steel wire.

As the handle 6*a* of the front plate 6 is urged rearward further, the sleeve roller 19 is caused to move downward and reaches the sliding guide member 35 to abut thereagainst. At this moment the movable wall 15 starts to turn about the shaft 16 in the clockwise direction, that is, in such a direction as to eliminate the pocket owing to the arrangement of the combination of the arms 17 and the sleeve roller 19 which are in operative connection to the movable wall 15. The movable wall 15 continues to turn until it is restored to the original position.

The pin 68 projected from the arm ratch 67 is brought in sliding engagement against the guiding face 71 of the arm ratch guide member 70, as the door casing is pivoted.

When the outer arcuate surface of the movabe wall 15 forms a continuation to that of the door casing 12, the guide ring 30 on the shaft 19*a* comes in rolling contact with the curved face 37' of the guide member 37. The turning movement of the movable wall 15 causes the bag or envelope held on the pocket to be thrown into the interior of the after hour depository. When the door casing 12 is fully closed, the shock absorbing member 48" disposed at the lower end part of the rotary stopper 48 comes in abutment against the lower stopper plate 49, while the outer arcuate surfaces of both the door casing 12 and the movable wall 15 are located on the same curved track. As a result, the bag or envelope containing money to be deposited is received in the receptacle 2 without any possibility of its being retained on the movable wall 15 (see FIG. 3).

Further, since the arcuate grooves 62 and 62' are recessed on both the inner side walls of the door casing 12 and the pins 63 projected from the side faces of the movable wall 15 are slidably fitted into the arcuate grooves 62 and 62' as described above, it is ensured that when the envelope becomes clogged in a close clearance between the inner side wall of the door casing 12 and the outer side face of the movable wall 15 for any reason, the pins 63 serve to remove it from the clearance and throw in into the receptacle.

Further, no clearance is defined between limiting plate 61 and moveable wall 15 since the limiting plate 61 fixedly secured to the inclined plate 60 is designed so as to correspond to the corrugated configuration of the outer arcuate surface 15*a* of the movable wall 15 when the latter is held in the fully closed state. It is thus ensured that the envelope is thrown into the receptacle without fail even when there is a tendency for the envelope to move along the corrugated surface 15*a* of the movable wall 15.

Another advantageous feature of the present invention consists in that there is no possibility of causing any stealing activity owing to the arrangements that the sleeve roller 19 is firmly held at the concave part 20*e* of the engagement pawl of the ratch 20. In such a manner, the auxiliary plate 25 is depressed by the shaft 16 when an unauthorized person attempts to steal the bag or envelope in the pocket with the use of a steel wire having a fishing hook or the like at its end while the door casing 12 is kept in the half closed state where the sleeve roller 19 is locked by means of the engagement pawl of the ratch 20. The limiting plate 61 thus becomes effective when the door casing 12 is kept in the fully closed state and the stealing activity protection plate 64 and the pins 63 on the side faces of the movable wall 15 become effective when it is kept in the half closed state. Thus, excellent safety and reliability are ensured for the after hour depository of the present invention.

Finally, the ratch mechanism will be additionally described below.

There is no possibility of opening the door casing 12 from the half closed state because of the fact that the ratch 20 fails to swing rearward due to the engagement of the retaining rod 20*a* on the ratch 20 with the rectangular recess 34 of the holding plate 33 and a resultant limited movement of the ratch 20 when an unauthorized person attempts to conduct a stealing activity with the use of a steel wire having a fishing hook or the like at the top end, said steel wire being inserted through a close clearance between the inner side wall of the framework 3 and the outer side wall of the door casing 12 for the purpose of swinging the ratch 20 in the rearward direction. Specifically, as long as the sleeve roller 19 is firmly held at the concave part 20*e* of the engagement pawl 20*c* of the ratch 20, anybody fails to open the door casing 12 from the half closed state due to the arrangement that the shaft 16 is effective in depressing the upper face of the auxiliary plate 25 of the ratch 20 even when he handles the steel wire or the like so as to swing the ratch 20 away from the engaged state. Moreover, since the corrugated outer surface of the door casing 12 is brought in engagement with the corresponding corrugated inner surface of the guide member 13 while the door casing 12 is half closed in that way, it is entirely impossible to steel the bag or the envelope held on the pocket through a close clearance therebetween.

As described above, the after hour depository in accordance with the present invention is very simple in structure and can be manufactured at an inexpensive cost. Further, it exhibits excellent safety against any stealing activity to be conducted by an unauthorized person owing to the arrangement that a combination of the sleeve roller on the door casing and the ratch on the side wall of the framework is effective to prevent the door casing from being opened by the thief while it is held in the half opened state. When operating the after hour depostory all that is required to be done is to push the door casing rearward after placing a bag or an envelope containing money to be deposited into the pocket which is developed when the door casing is drawn forward. Another advantageous feature of the present invention is that the after hour depository is reliable and safe during operation, since the movable wall is adapted to move without any fail in cooperation with the sliding member and others.

While the present invention has been described merely with reference to a single preferred embodiment as illustrated in the accompanying drawings, it should be of course understood that various changes or modifications may be made by those persons in the art without departing from the spirit and scope of the invention.

What is claimed is:

1. An after hour depository comprising a door casing having inside walls and adapted to be fitted into a framework in a building so as to be pivotal between open and closed positions about a shaft horizontally extending across both side walls of the framework, movable wall means disposed in operative association with the door casing for developing a pocket into which a bag or an envelope containing money to be deposited is placed, a rotary stopper fixedly secured to the lower part of the door casing to define said closed position, a sleeve roller disposed rotatably about a roller shaft horizontally extending across both the side walls of the door casing and displaceable together with the movable wall, ratch means for guiding and defining the movement of the sleeve roller, said ratch means being pivotally secured to the side wall of the framework, a sliding member fixedly secured to the side wall of the framework so as to allow the movable wall to be pivoted in such a direction to eliminate the pocket in cooperation with the sleeve roller, and protection means for protecting against criminal activity, said protection means including means defining at least one arcuate groove on the inside walls of the door casing, said arcuate groove having a center of curvature coincident with the pivotal axis of the movable wall and pins projecting from side faces of the movable wall and operatively fitted into the arcuate grooves.

2. An after hour depository as defined in claim 1, wherein said ratch mechanism comprises a ratch including an engagement pawl formed with a concave part at which the sleeve roller is adapted to be firmly held during return movement to said closed position, an auxiliary plate integral with said ratch, a driving plate located opposite to the ratch, said driving plate being normally operable to pivot in an opposite direction relative to the ratch, a holding plate in operative association with the driving plate, and retaining rod means fixedly secured to said ratch for causing said holding plate to come into engagement with or be disengaged from the ratch.

3. An after depository as defined in claim 2, wherein said ratch includes means preventing incorrect pivotal movement of said ratch, said movement preventing means having shaft means depressable against an upper face of the auxiliary plate of the ratch.

4. An after hour depository as defined in claim 1, wherein said protection means comprises a theft protection plate fixedly secured to the movable wall at its lower end part and arm ratch means attached to the door casing, said arm ratch means for locking the sleeve roller when said door casing is in said open position, so that any clearance established between the door casing and the guide member is completely filled.

5. An after hour depository as defined in claim 1, wherein a limiting plate is attached to an inclined plate disposed at the inlet to the chute which is located in the vicinity of the lower end part of the movable wall, said limiting plate having a corrugated configuration corresponding to that of the movable wall, so that the former is closely engaged to the latter.

6. An after hour depository as defined in claim 1, wherein the depository is equipped with a locking mechanism comprising a rotary locking plate adapted to be rotated by means of a key fitted into a cylinder lock on the framework so as to lock the movement of the door casing.

7. An after hour depository as defined in claim 1, wherein the depository is equipped with a locking mechanism comprising a locking rod adapted to be engaged to or disengaged from a recessed part on the side wall of the door casing by means of a key fitted into a cylinder lock on the framework so as to lock or unlock the movement of the door casing.

8. An after hour depository as defined in claim 1, wherein the sleeve roller is arranged such that it is located outward of the ratch when the door casing is opened while the movable wall is turned with the aid of a sliding member.

9. An after hour depository as defined in claim 1, wherein the door casing includes a concave partition which is adapted to come in sliding contact with the free end of the movable wall.

10. An after hour depository as defined in claim 1, wherein the movable wall is turned downward due to its own dead weight when the sleeve roller leaves the upper end of the ratch in the cource of the door opening.

11. A security depository for valuables comprising:

a frame;

a door casing pivotally mounted to said frame for movement between closed and open positions and defining a pocket into which valuables are placed while said door is in said open position;

a movable wall member including mounting means for pivotally mounting one end of said wall member to said door casing to permit pivotal movement of said wall member between a first position wherein access to said pocket is precluded and a second position wherein access to said pocket is permitted in response to said door casing being pivotally moved between said closed and open positions, respectively, said moveable wall member including at said one end thereof theft protection plate means for blocking any clearance defined between said moveable wall member and said frame when said wall member is moved to said second position; and means operatively associated with said movable wall member for preventing direction reversal of the pivotal movement of said door casing when said door casing is pivotally moved in a closing direction between said open position and said closed position, said direction reversal preventing means including (a) first and second opposing pivotal ratch members defining a space therebetween, said first ratch member defining a cam surface and said second ratch member defining a latch surface, (b) holding plate means pivotally attached to said first ratch member and movable between engaged and disengaged positions with said second ratch member is response to said first ratch member being pivoted between forward and rearward positions, respectively, said holding plate means for preventing pivotal movement of said second ratch member when said holding plate means is in said engaged position and for permitting pivotal movement of said second ratch member when said holding plate means is in said engaged position, and (c) roller means rotatably mounted to said wall member and movable therewith into said space upon pivotal movement of said door casing in said closing direction, said roller means for initially contacting said cam surface during pivotal movement of said door casing in said closing direction to pivot said ratch member between said forward and rearward positions to responsively move said holding plate means to said disengaged position, said roller means for thereafter contacting said latch surface of said second ratch member to prevent movement reversal of said door casing in a direction opposite said closing direction.

12. A depository as in claim 11 wherein said second ratch member further includes means defining a second cam surface in said space and downstream of said first mentioned cam surface to pivotally move said second ratch member between advanced and retracted positions in response to said roller coming into contact therewith after said holding plate means has moved to said disengaged position by virtue of said roller means initially coming into contact with said first mentioned cam surfaces.

13. A depository as in claim 12 wherein said first ratch member includes first biasing means for biasing said first ratch member into said forward position and for biasing said holding plate means into said engaged position.

14. A depositor as in claim 13 wherein said second ratch member includes second biasing means for biasing said second ratch member into said advanced position.

15. A depository as in claim 11 wherein said first ratch member includes first biasing means for biasing said first ratch member into said forward position and for biasing said holding plate means into said engaged position.

16. A depository as in claim 12 wherein said second ratch member includes second biasing means for biasing said second ratch member into said advanced position.

17. A depository as in claim 11 further comprising guide means fixed to said frame for guiding said roller means during pivotal movement of said door casing in a direction towards said open position.

18. A depository as in claim 11 further comprising locking means associated with said frame to permit authorized access to said pocket.

19. A depository as in claim 18 wherein said locking means includes a recess defined in said frame, a lock cylinder fixed to said frame, a key insertable into said lock cylinder and turntable therein between locked and unlocked positions, and rotary locking plate means operatively associated with said lock cylinder and movable into and out of engagement with said recess in response to said key being turned between said locked and unlocked positions, respectively.

20. A depository as in claim 18 wherein said locking means includes a recess defined in said frame, a lock cylinder, a key insertable in said cylinder and turntable therein between locked and unlocked positions, rod means reciprocially movable into and out of said recess and means for translating the turning movement of said key to reciprocal movement of said rod means so that said rod means reciprocally moves into and out of said recess in response to said key being turned between said locked and unlocked position, respectively.

21. A depository as in claim 11 further comprising lamp means for illuminating the exterior thereof.

22. In combination with a building, a depository as in claim 11.

23. A depository as in claim 11 further comprising means permitting free pivotal movement of said door casing between said closed position and an intermediate position wherein said pocket is partially defined while yet preventing pivotal movement from said intermediate position to said open position.

24. A depository as in claim 23 further comprising locking means associated with said frame to permit said door casing to be pivoted towards said open position beyond said intermediate position.

25. A depository as in claim 1 wherein said theft protection means includes means defining a pair of arcuate grooves each having a center of curvature coincident with the pivot axis of the movable wall.

* * * * *